United States Patent [19]

Suzuki

[11] Patent Number: 4,475,429

[45] Date of Patent: Oct. 9, 1984

[54] ELECTRONIC EQUIPMENT WITH TONE GENERATING FUNCTION

[75] Inventor: Kazuyasu Suzuki, Tokyo, Japan

[73] Assignee: Casio Computer Co., Tokyo, Japan

[21] Appl. No.: 531,579

[22] Filed: Sep. 12, 1983

Related U.S. Application Data

[63] Continuation of Ser. No. 331,171, Dec. 16, 1981, abandoned.

[30] Foreign Application Priority Data

Dec. 27, 1980 [JP] Japan ..... 55-187456

[51] Int. Cl.[3] ..... G10H 1/06; G10H 7/00

[52] U.S. Cl. ..... 84/1.19; 84/1.21

[58] Field of Search ..... 84/1.11–1.13, 84/1.19–1.23

[56] References Cited

U.S. PATENT DOCUMENTS 4,283,983 8/1981 Kashio ..... 84/1.19
4,352,311 10/1982 Luce et al. ..... 84/1.19
4,358,980 11/1982 Imamura ..... 84/1.19

FOREIGN PATENT DOCUMENTS 2029582 12/1971 Fed. Rep. of Germany .

*Primary Examiner*—S. J. Witkowski
*Attorney, Agent, or Firm*—Frishauf, Holtz, Goodman & Woodward

[57] ABSTRACT

Electronic equipment having a tone generating function of the invention has a timbre waveform memory for providing timbre to a frequency signal corresponding to each note. The timbre waveform memory is constituted by n bits for each timbre, each bit storing a binary coded signal of level "1" or "0" in accordance with the type of timbre. The timbre waveform stored in the timbre waveform memory corresponds to each numeric code and is specified by a key-in operation of numeric keys.

11 Claims, 13 Drawing Figures

FIG. 4

| SCALE | KEY OPERATION | f (Hz) | COUNT VALUE | F2 | F1 | F0 | CODE |
|---|---|---|---|---|---|---|---|
| $A_3$ | [•] | 220.0 | 909 | 3 | 7 | 3 | 1 |
| $A_3^{\#}$ | [+/−] [•] | 233.1 | 858 | 3 | 4 | 6 | 2 |
| $B_3$ | [0] | 246.9 | 810 | 3 | 1 | 6 | 3 |
| $C_4$ | [1] | 261.8 | 764 | 2 | 14 | 4 | 4 |
| $C_4^{\#}$ | [+/−] [1] | 277.0 | 722 | 2 | 12 | 4 | 5 |
| $D_4$ | [2] | 293.7 | 681 | 2 | 9 | 7 | 6 |
| $D_4^{\#}$ | [+/−] [2] | 311.0 | 649 | 2 | 7 | 13 | 7 |
| $E_4$ | [3] | 329.5 | 607 | 2 | 4 | 1 | 8 |
| $F_4$ | [4] | 349.0 | 573 | 2 | 2 | 3 | 9 |
| $F_4^{\#}$ | [+/−] [4] | 369.7 | 541 | 2 | 0 | 3 | 10 |
| $G_4$ | [5] | 392.2 | 510 | 1 | 14 | 2 | 11 |
| $G_4^{\#}$ | [+/−] [5] | 414.9 | 482 | 1 | 13 | 14 | 12 |
| $A_4$ | [6] | 439.6 | 455 | 1 | 11 | 9 | 13 |
| $A_4^{\#}$ | [+/−] [6] | 466.2 | 429 | 1 | 9 | 3 | 14 |
| $B_4$ | [7] | 493.8 | 405 | 1 | 8 | 11 | 15 |
| $C_5$ | [8] | 523.6 | 382 | 1 | 6 | 2 | 16 |
| $C_5^{\#}$ | [+/−] [8] | 554.0 | 361 | 1 | 5 | 7 | 17 |
| $D_5$ | [9] | 586.5 | 341 | 1 | 4 | 11 | 18 |
| $D_5^{\#}$ | [+/−] [9] | 623.1 | 321 | 1 | 3 | 15 | 19 |
| $E_5$ | [÷] | 660.1 | 303 | 1 | 2 | 1 | 20 |
| $F_5$ | [X] | 699.3 | 286 | 1 | 0 | 2 | 21 |
| $F_5^{\#}$ | [+/−] [X] | 740.7 | 270 | 0 | 15 | 2 | 22 |
| $G_5$ | [—] | 784.3 | 255 | 0 | 14 | 1 | 23 |
| $G_5^{\#}$ | [+/−] [—] | 829.9 | 241 | 0 | 14 | 5 | 24 |
| $A_5$ | [+] | 881.1 | 227 | 0 | 13 | 13 | 25 |
| $A_5^{\#}$ | [+/−] [+] | 930.2 | 215 | 0 | 12 | 9 | 26 |
| $B_5$ | [=] | 990.1 | 202 | 0 | 11 | 6 | 27 |

AMPLIFIER 21
65
R1
R21
R31
R22
R32
R23
R33
R24
-VDD
GND
P
N
TR1
TR2
TR3
TR4
FROM NAND GATE 61~64
35
59
OR GATE 60
52
18
58
EXCUSIVE NOR GATE 53~56
FROM AND GATE 57
46
47
R
S
Q
D
φd
TO AND GATE 45
TO INVERTER 48
FROM INVERTER 51
FROM BUFFER 26

| CODE | TONE |
|---|---|
| 1 | PIANO |
| 2 | FLUTE |
| 3 | PRETTY TONE |
| 4 | VIOLIN |
| 5 | GUITAR |
| 6 | KOTO |
| 7 | TRUMPET |

ELECTRONIC EQUIPMENT WITH TONE GENERATING FUNCTION

This application is a continuation of application Ser. No. 331,171 filed Dec. 16, 1981 and now abandoned.

BACKGROUND OF THE INVENTION

The present invention relates to electronic equipment with a tone generating function such as an electronic musical instrument, an electronic portable calculator with a tone generating function, or the like, which effectively adds timbre to a tone.

In an electronic musical instrument such as an electronic organ, conventionally, timbre which resembles timbre produced by natural musical instruments such as piano, flute and the like is added for natural performance. In order to produce timbre for piano, flute and the like, various harmonic sounds of, for example, a sinusoidal waveform are synthesized or specific waveforms inherent to natural musical instruments are stored in a memory and read out as needed.

However, in the above conventional methods, a complex controlling system is required for synthesizing the various harmonic sounds and a large storage is required for storing the specific waveforms of natural musical instruments.

In general, a tone lever or a draw lever for controlling timbre is built into the electronic musical instrument such as an electronic organ. For this reason, the number of switches increases and results in a bulky unit and complex operations. On the other hand, electronic portable equipment such as an electronic portable calculator with which simple melody performance is made by the simple key-in operation with the keys or the like has recently been developed. However, the electronic portable calculator is too compact to incorporate a timbre control switch. Therefore, the timbre of a produced tone becomes monotonous.

SUMMARY OF THE INVENTION

It is an object of the present invention to provide electronic equipment with a tone generating function which adds timbre to a frequency signal with a simple circuit arrangement and a timbre waveform memory of small capacity from which timbre data is read out and added to the frequency signal.

It is another object of the present invention to provide electronic equipment with a tone generating function in which numeric keys are arranged to key in data which represents a type of timbre, and desired timbre is specified by the depression of the numeric keys.

The electronic equipment of the present invention comprises frequency signal generating means for generating a frequency signal in correspondence with desired note data; timbre waveform memory means for giving timbre to the frequency signal which is generated by said frequency signal generating means, said timbre waveform memory means being constituted by n bits for each type of timbre, each bit storing a binary coded signal of level "1" or "0" in accordance with the type of timbre; and address means for sequentially accessing, at intervals of a period of frequency signal, an address of each bit among the n bits of data which is stored in said timbre waveform memory means in response the frequency signal.

With the above arrangement, a timbre waveform memory in which one type of timbre is constituted by n bits, and a signal "1" or "0" corresponding to a type of timbre is stored in each bit, so that timbre can be readily added with a simple circuit by changing a duty.

Further, the designation of timbre is performed by the numeric keys, so that the number of switches for selecting timbre is reduced, resulting in compact electronic equipment with a tone generating function.

BRIEF DESCRIPTION OF THE DRAWINGS

FIG. 4 is a table for explaining the relations among key operations corresponding to a note, a frequency, a counting value, a note code and a code;

DETAILED DESCRIPTION OF THE PREFERRED EMBODIMENTS

Figure 1:
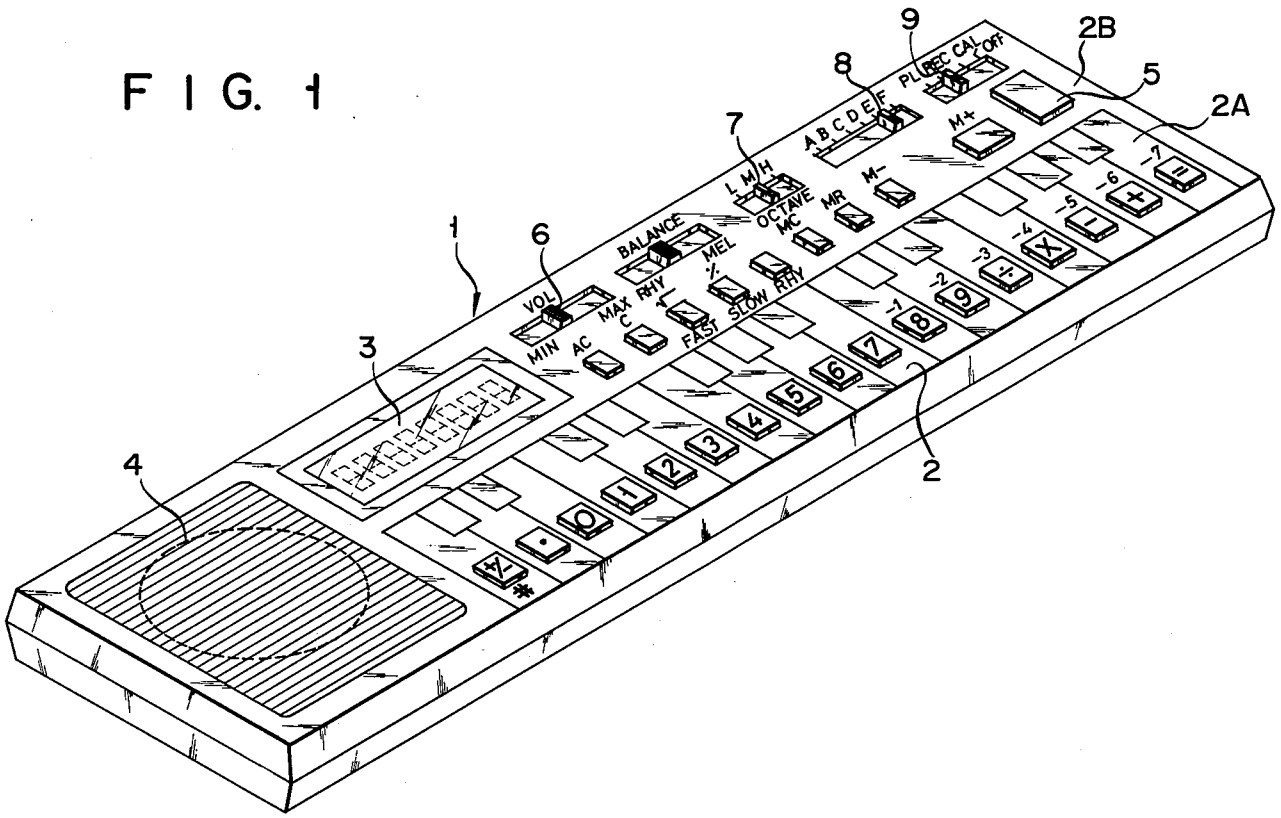
FIG. 1 is a perspective view of an outer appearance of an electronic portable calculator with a tone generating function when the present invention is applied thereto.

One embodiment of the present invention which is applied to an electronic portable calculator with a tone generating function will be described with reference to the accompanying drawings. Referring to FIG. 1, a key input section 2 with various keys, a display section 3 and a sound producing section 4 are arranged on a case 1 of the electronic portable calculator. An LSI (Large Scale Integration device) which constitutes a circuit in FIG. 2, a battery and the like are disposed within the case 1. Keys which are used for calculation of the electronic portable calculator and keys which are used for performing a melody are arranged in the key input section 2. In particular, ten keys [0] to [9] and various function keys [÷], [×], . . . , [=], [AC], and [M+] are used for calculation. Seventeen keys on a key control section 2A of the key input section 2, such as keys [+/−], [.], . . . and [=] are utilized for pitch designation keys of pitches A3 to B5 besides the original functions. A [√] key 5*a* and a [%] key 5*b*, are respectively, utilized as tempo keys which, besides their original functions, respectively increase and decrease the tempo level by one level. Further, a [RHY] key 5*c* together with the ten keys [0] to [9] is used as a rhythm designation key which selects one among the ten kinds of rhythm patterns (FIG. 7). [MC], [MR], [M−], and [M+] keys are, respectively, utilized for melody read-in and read-out keys besides their original functions. Reference numeral 5 denotes a one-key play key; 6, a volume switch; 7, an octave shift switch; 8, a timbre designation switch; and 9, a mode changeover switch. The one-key play key 5 is for reading out pitch data for one note of a melody which is preset in a memory 17 to be described later and performs this melody. The octave shift switch 7 shifts one octave for notes A3 to B5 upward or downward. The timbre designation switch 8 has changeover positions A to E and F. At the positions A to E, five kinds of timbre such a piano and the like are specified. At the position F, data is input for setting time for ADSR, and timbre in the one-key play or the like. Further, the mode changeover switch 9 has changeover positions PL, REC, CAL, and OFF. The position PL designates the play mode, the position REC designates the recording mode, the position CAL designates the calculation mode, and the position OFF designates the power-off mode.

Among the seventeen pitch designation keys, the [+/−] key is a semitone key, the [.] and [0] keys designate pitches A and B of the third octave, the [1] to [7] keys designate pitches C to B of the fourth octave, and the [8] to [=] keys designate pitches C to B of the fifth octave. When the semitone key is depressed, for example, when the pitch A3# is to be produced, the sequential key-in operation of the [+/−] and [.] keys must be performed. A keyboard pattern is printed on the key control section 2A in order to indicate that th [+/−] to [=] keys, respectively, correspond to the musical scale as described above. Further, the pitches C to B correspond to numbers 1 to 7 in the key control section 2A. In the third octave, a bar (−) is marked at the lower left corner of the numbers. The numbers 1 to 7 which correspond to the notes of the fourth octave are not marked with the bar. Numbers which correspond to the notes of the fifth octave are marked with the bar at the upper left corner in the key control section 2A.

The display section 3 comprises a liquid crystal display section in which eight characters are displayed for numbers and notes.

Figure 2:
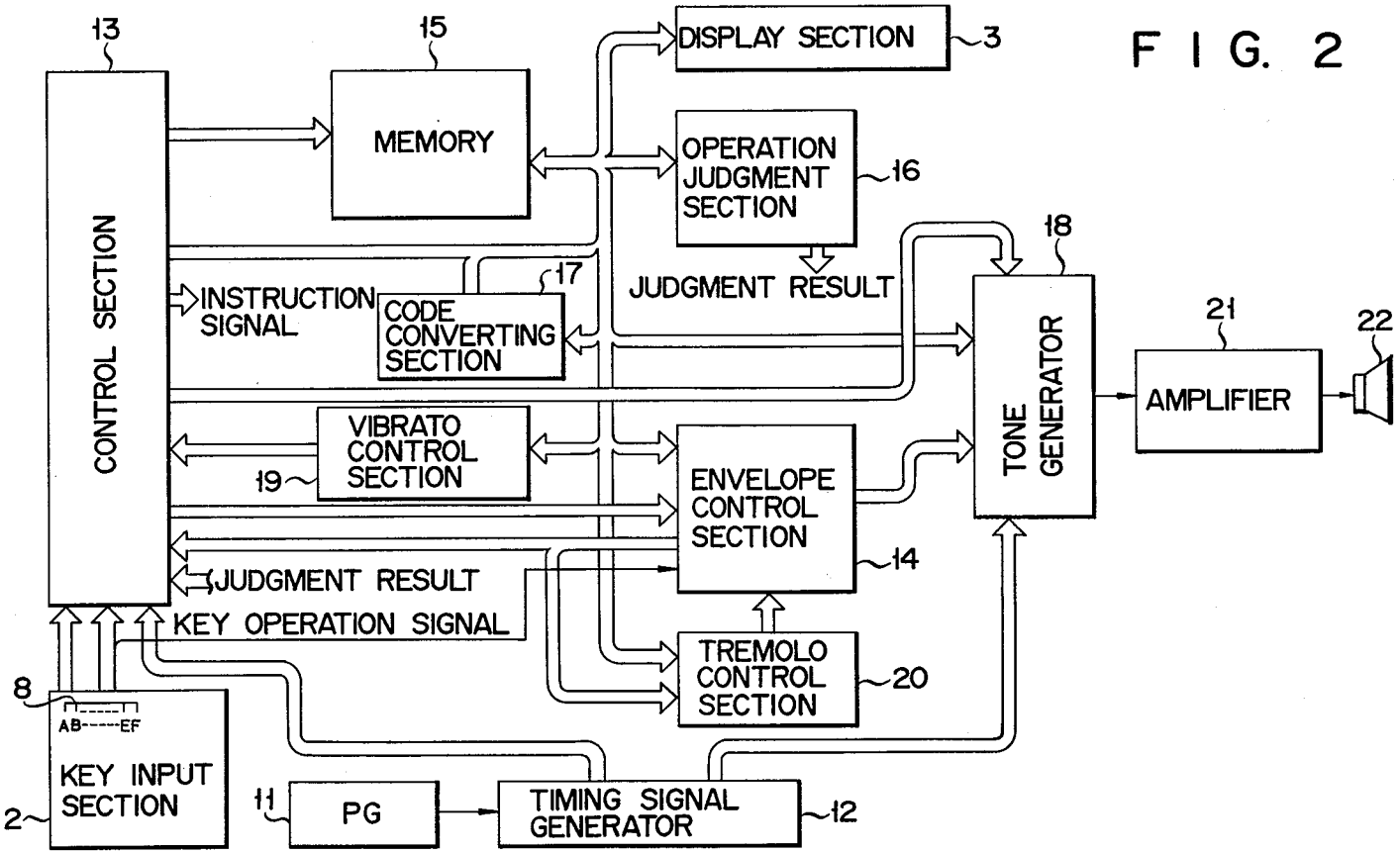
FIG. 2 is a block diagram of the electronic portable calculator of FIG. 1.

The circuit diagram of the electronic portable musical instrument with a tone generating function will be described with reference to FIG. 2. An oscillator 11 constantly oscillates to output signals having a predetermined frequency. The oscillation signal is supplied to a timing signal generator 12. The oscillation signal is frequency-divided at the timing signal generator 12. The divided signals are supplied to a tone generator 13 as clock signals having frequencies of 50 kHz, 100 kHz and 200 kHz, and to other circuits such as a control section 13 of FIG. 2 as various timing signals so as to operate these circuits.

A key control signal which is supplied from the key input section 2 or a key-in signal is supplied to a envelope control section 14. The control section 13 stores microprograms which control operations in various modes of the electronic portable calculator. In the calculation and melody performance modes, when each key control signal is supplied to the control section 13, the control section 13 identifies the key from which that key control signal is transmitted and outputs a microinstruction in response to the signal. In the calculation mode, when the ten keys are depressed, numeric data corresponding to the depressed keys is output and stored in an operating register of the memory 15. When one of the function keys is depressed, the corresponding instruction signal is output. The numeric data which is stored in the operating register is transferred to an operation judgment section 16 in which a proper operation is performed, accomplishing four arithmetic operations or the like. Further, in the recording mode, the [+/−] to [=] keys are depressed to perform a melody so that the control section 13 writes codes 1 to 27 which designate pitches corresponding to the respective key control signals in predetermined areas within the memory 15. The codes 1 to 27, respectively, correspond to pitches of the notes A3 to B5. The pitch data (data which is represeted by one of the codes 1 to 27) which is written in the predetermined area in the memory 15 is sequentially read out every time the one-key play key 5 is depressed in the play mode, accomplishing one-key playing at a tone generator 18. Further, in the play mode, the melody performance with the pitch designation keys is performed with rhythmic accompaniment (rhythm circuit is not shown) at the tone generator 18 under the control of the control section 13.

Figure 3A:
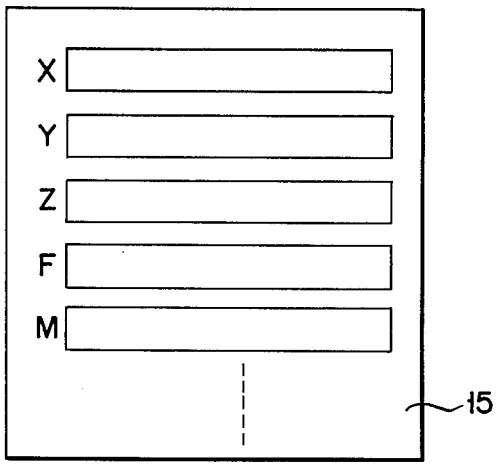
FIG. 3A shows a register configuration in a memory.
Figure 3B:
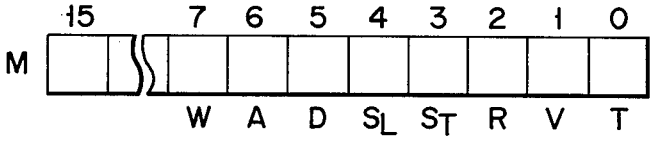
FIG. 3B is a detailed view illustrating an M register.

The memory 15 comprises a RAM (random access memory) which has X, Y, Z, F and M registers of 16 bits as shown in FIG. 3A. The X, Y and Z registers are used for calculation and are mainly used in the calculation mode, First, second and third areas F0, F1 and F2 of the F register store a note code (FIG. 4) to be described later. The M register stores data such as an attack of an envelope and data for specifying timbre (timbre code). The above data is input by depressing the ten keys. The X register is utilized as a display register, besides its original function, so that data in the X register is supplied to the display section 3 to be displayed there. The timbre designation data is stored in the 8th bit M7 of the M register, as shown in FIG. 3B.

The operation judgment section 16 performs the four arithmetic operations and other judging operations in each mode. In this case, data for arithmetic operations is supplied from the various registers in the memory 15 and the control section. The operated results are stored in a specified register in the memory 15. The judged results in the juding operation are supplied to the control section 13 so that these results are used for producing a subsequent microinstruction.

A code converting section 17 is a circuit which writes, in the first to third areas F0 to F2 to the F register, the note code which is converted from the corresponding code among the codes 1 to 27 which are stored in first and second areas X0 and X1 of the X register. In this case, as described above, the codes 1 to 27, respectively, correspond to the pitches A3 to B5. Therefore, the codes 1 to 27 have a predetermined relation with the note codes as shown in FIG. 4, so that a tone whose pitch corresponds to the specific note code is produced at the tone generator 18. In both recording and play modes, when a pitch designation key is depressed, codes corresponding to the first and second areas X0 and X1 of the X register are written therein under the control of the control section 13. In the recording mode, the codes which are written in the first and second areas X0 and X1 of the X register are further transferred to and stored in predetermined areas of the memory 15. Further, the codes which are stored in the predetermined areas in the memory 15 or in the first and second areas X0 and X1 of the X register are converted to the corresponding note codes by the code converting section 17 and are written in the first to third areas F0 to F2 of the F register when the melody performance is accomplished. The codes which are stored in the first to third areas F0 to F2 of the F register are sequentially transferred to the tone generator 18 and are utilized for generating tones as described above. The relation between the above code and the note code is shown in FIG. 4. For example, in the case of the note A4, the key code "13" corresponds to "1" (F2), "11" (F1) and "9" (F0). The frequency f thereof which is 439.6 Hz is the actual frequency of the pitch of the note A4, and the counting value 455 is the counting value for producing the frequency f (439.6 Hz) at the tone generator 18, and the description thereof will be described later.

An envelope control section 14 performs an envelope control in correspondence with data which is stored in the M register (M0 to M2) of the memory 15 under the control of the control section 13. To the envelope control section 14 are supplied the control signal from the control section 13, the key-in signal from the key input section 2, data from the M register, and the control signal from a tremolo control section 20, so that the operation of the sound pressure counter (not shown) in the envelope control section 14 is controlled and the counting values "0" to "15" of the sound pressure counter are supplied to the tone generator 18 as the envelope data.

A vibrato control section 19 is a circuit which controls the operation of providing vibrato to the envelope data output from the envelope control section 14, based on the vibrato data which is set in the M register (M1). When the vibrato data is input from the M register, the corresponding control data is produced and supplied to the control section 13. The control section 13 supplies, to the tone generator 18, a control signal by which the frequency of the pitch of the note is changed by a predetermined value.

The tremolo control section 20 is a circuit which controls the operation of providing a tremolo to the envelope data in statuses such as a sustain S, and a release R, based on the tremolo data which is stored in the R register (M0). When the tremolo data is input from the M register, the counting operation of the sound pressure counter in the envelope control section 14 is controlled and a tremolo is given to the envelope data under the control of the envelope control section 14.

The tone generator 18 receives the note code from the F register in the memory 15, the envelope data, the timing signal, and a timbre code and an octave code to be described later and produces a tone signal. The synthesized tone signal is converted to an analog tone signal and is produced at a sound producing section 4 through an amplifier 21 and a speaker 22.

Figure 5A:
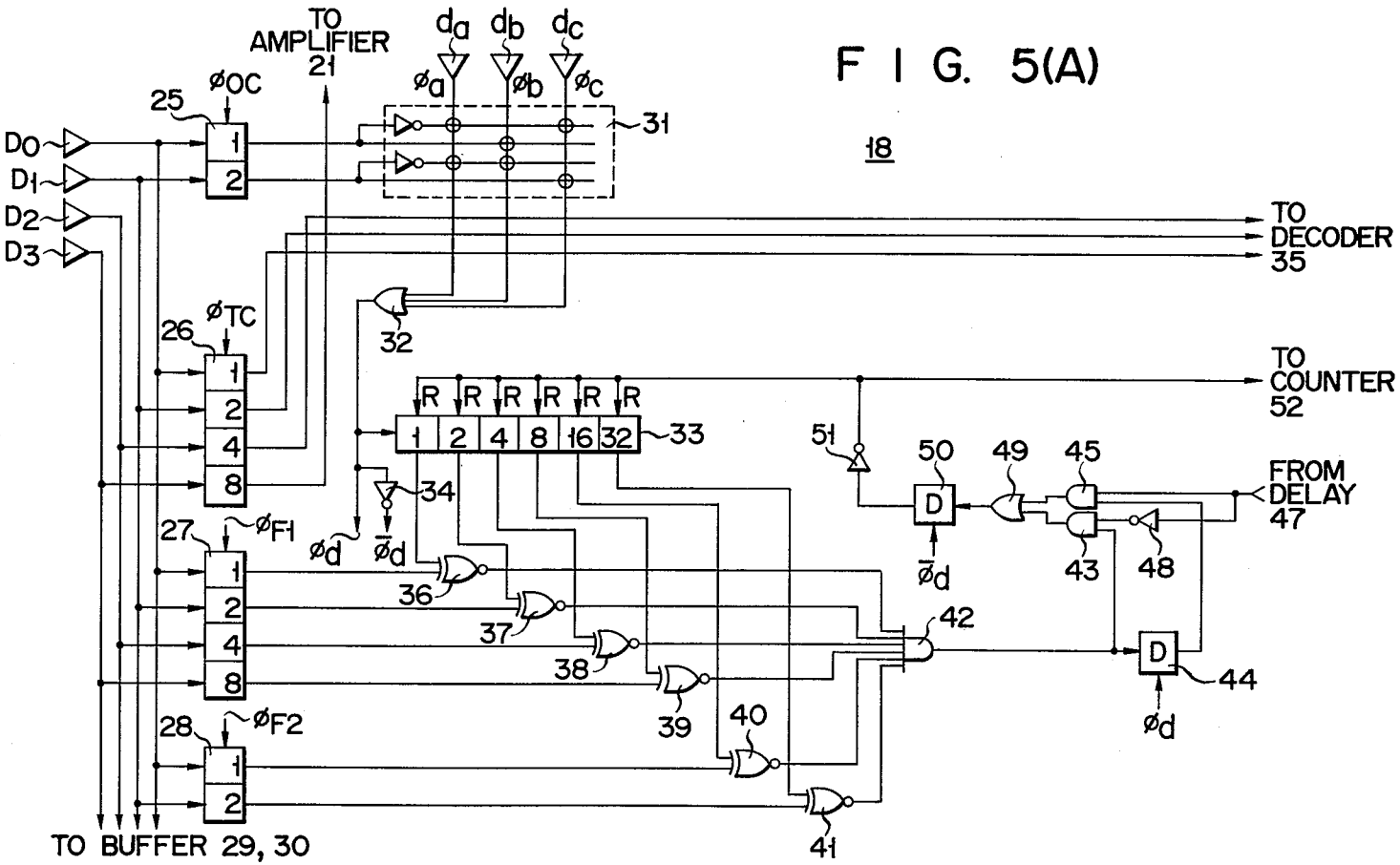
FIGS. 5A to 5D are detailed circuit diagrams of a tone generator.
Figure 5B:
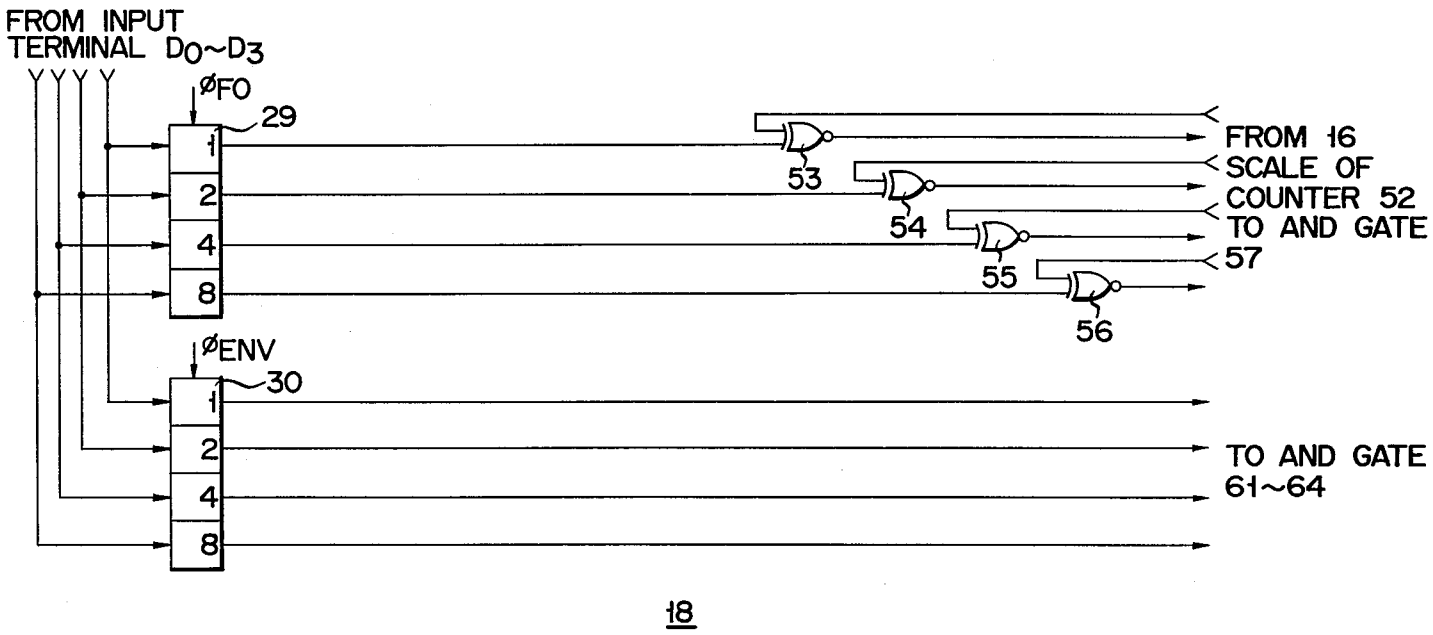
Figure 5C:
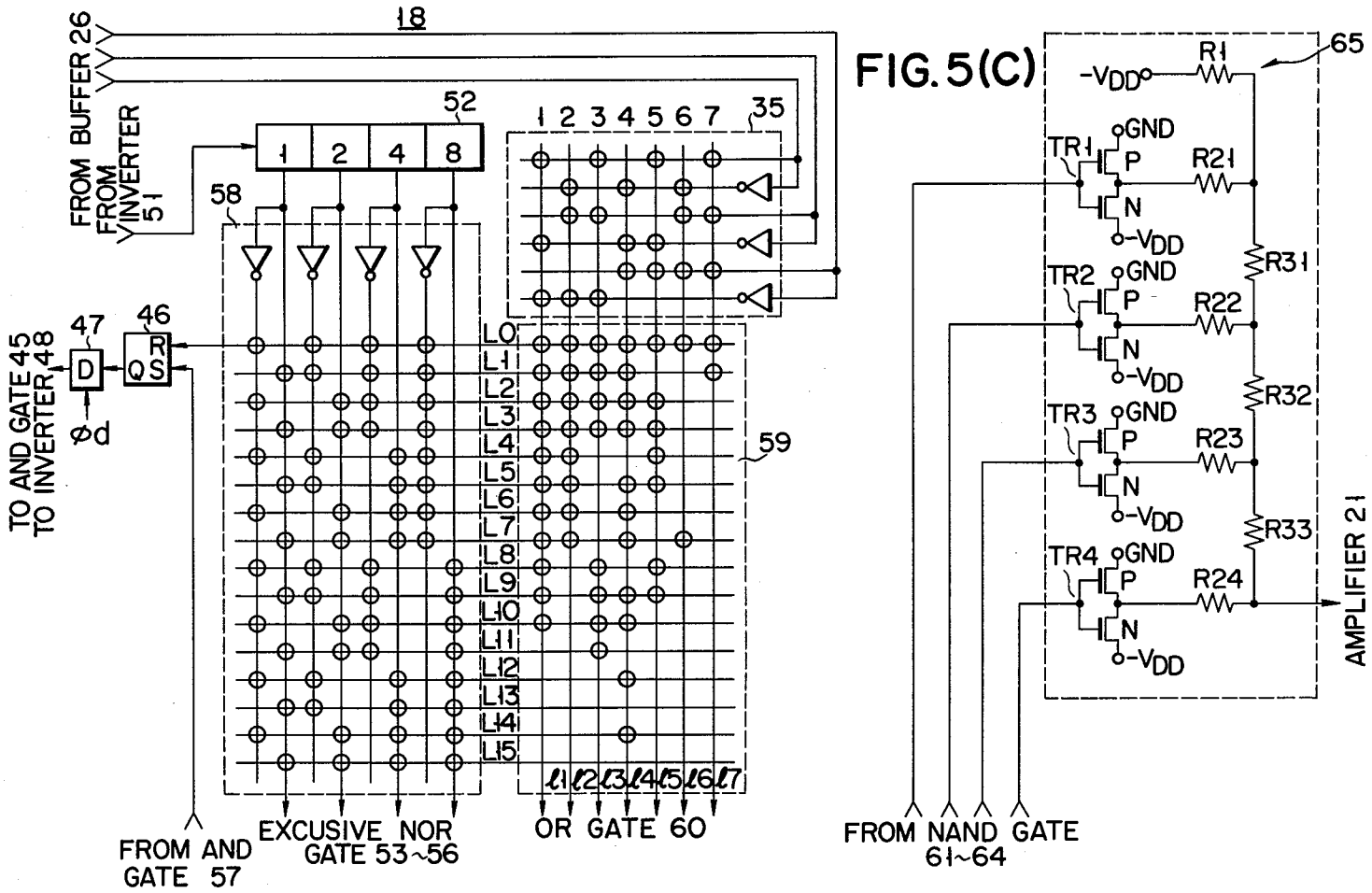
Figure 5D:
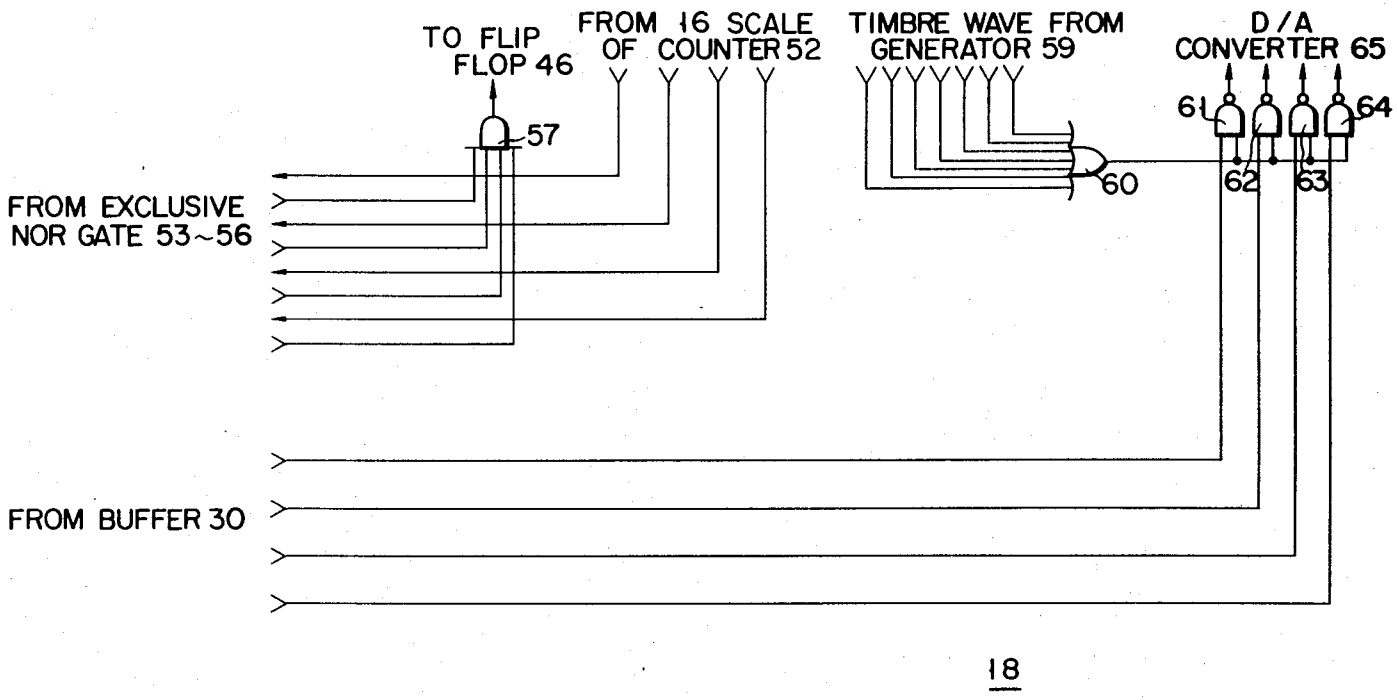
Figures 5E, 7:
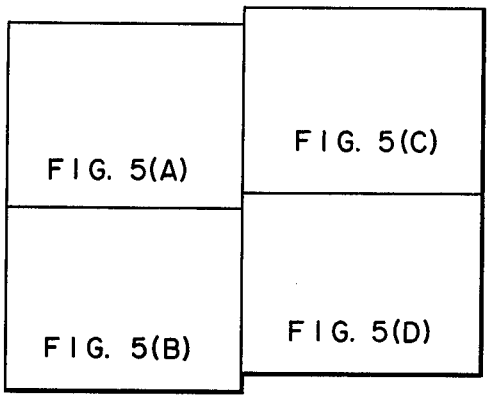
FIG. 5E is a view for explaining the connections among the tone generators shown in FIGS. 5A to 5D.
FIG. 7 is a table for explaining the relation between the timbre code and a timbre.

The detailed arrangement of the tone generator 18 will be described with reference to FIGS. 5A to 5E. The connections among the circuits shown in FIGS. 5A to 5D are shown in FIG. 5E. To data input ends D0, D1, D2 and D3 (FIG. 5A), respectively, are supplied the octave code (2 bits) and the timbre code (4 bits) from the control section 13, the F1 code (4 bits), the F2 code (2 bits) and the F0 code (4 bits) from the F register, and the envelope data (4 bits) from the envelope control section 14. The octave code is supplied to a buffer register 25 which is driven by a clock signal $\phi$OC, the timbre code is supplied to a buffer register 26 which is driven by a clock signal $\phi$TC. The F1, F2 and F0 codes are, respectively, supplied to buffer registers 27, 28 and 29 which are, respectively, driven by clock signals $\phi$F1, $\phi$F2 and $\phi$F3. Further, the envelope data is supplied to a buffer register 30 which is driven by a clock signal $\phi$ENV. Numbers 1, 2, 4, 8 indicated in the respective buffer registers 25 to 30 denote binary weighting, and the same binary weighting is applied to other buffer registers and counters. When the content of the octave code is 0, 1, or 2 (decimal notation), 0, 1, or 2 indicates the third octave, the fourth octave and the fifth octave. This octave code is supplied to a decoder 31 and is decoded therein. Clock signals $\phi$a, $\phi$b and $\phi$c having frequencies of 200 kHz, 100 kHz and 50 kHz which are generated from the timing signal generator 12 are supplied to the decoder 31 through data input ends da, db and dc. When the octave code within the buffer register 25 is 0, 1, or 2, the clock signals $\phi$a, $\phi$b and $\phi$c are selectively output from the decoder 31. The output clock signal is supplied through an OR gate 32 to a counter 33 in which the clock signal is counted. The output from the OR gate 32 is defined as a clock signal $\phi$d. When the clock signal $\phi$d is supplied to an inverter 34 and inverted therein, this inverted clock signal is defined as $\overline{\phi d}$.

The timbre code is automatically output from the control section 13 when the timbre designation switch 8 is set to one of the positions A to E. The timbre codes "1" to "5", respectively, correspond to timbre of piano, flute, pretty, violin and guitar, which are supplied to the buffer register 26. When the timbre designation switch 8 is set to the position F, the codes "1" to "7" (which, respectively, correspond to timbre of piano, flute, pretty, violin guitar, harp and trumpet as shown in the table of FIG. 7) which are output from the control section 13 are supplied to the buffer register 26. Further, the timbre code which is read in the buffer register 26 and which comprises lower three bits of the four bits is supplied to the decoder 35 (FIG. 5C) to be decoded thereby. The fourth bit (MSB) of the timbre code is supplied to the amplifier 21 and the speaker 22. When the content at the fourth bit is "1", power is supplied to the amplifier 21 and the speaker 22 and a specified tone is produced therefrom. When the content is "0", power is not supplied to the amplifier 21 and the speaker 22 and the tone is not produced.

The F1 code and the F2 code which are, respectively, read in the buffer registers 27 and 28 are supplied to the corresponding first input ends of exclusive NOR gates 36, 37, 38, 39, 40 and 41. On the other hand, the counting value data (6-bit data) from the counter 33 is supplied to the second input ends of the exclusive NOR gates 36 to 41. Therefore, actually, 6-bit data is produced by the F1 code (4-bit data) and the F2 code (2-bit data). The 6-bit data and the counting value data from the counter 33 are compared by the exclusive NOR gate 36 to 41. The outputs from the exclusive NOR gates 36 to 41 are supplied to an AND gate 42. Therefore, when the content of the 6-bit data and the content of the counting value data coincide, the signal "1" is output from the AND gate 42.

The output from the AND gate 42 is supplied to an AND gate 43 and at the same time to a one-bit delay circuit 44 in response to the clock signal $\phi$d. The output from the one-bit delay circuit 44 is supplied to an AND gate 45. Further, in response to the clock signal $\phi$d, to the AND gates 43 and 45 is supplied, directly or through an inverter 48, a one-bit delayed signal from the one-bit delay circuit 47, which is obtained by delaying the set output of an SR flip-flop 46 by one bit. The outputs from the AND gates 43 and 45 are supplied to a delay circuit 50 through an OR gate 49. Therefore, the delay circuit 50 performs the one-bit delay operation in response to the clock signal $\phi$d, and the output therefrom is supplied to a reset input end R of the counter 33 through an inverter 51, so that the counter 33 is reset. The output signal from the delay circuit 50 is also supplied to a 16-scale of counter 52 for counting.

The F0 code which is read in the buffer 29 is supplied to first input ends of corresponding exclusive NOR gates 53 to 56. On the other hand, the counting value data from the 16-scale of counter 52 is supplied to the second input ends of the exclusive NOR gates 53 to 56.

The content of the F0 code and the content of the counting value data from the 16-scale of counter 52 are compared by the exclusive NOR gates 53 to 56. The respective outputs from the exclusive NOR gates 53 to 56 are supplied to an AND gate 57 (FIG. 5D). When the content of the F0 code and the content of the counting value data of the 16-scale of counter 52 coincide, the AND gate 57 outputs the signal "1". The output from the AND gate 57 is supplied to the set input end S of the SR flip-flop 46 (FIG. 5C) so that the flip-flop 46 is set.

Figure 8:
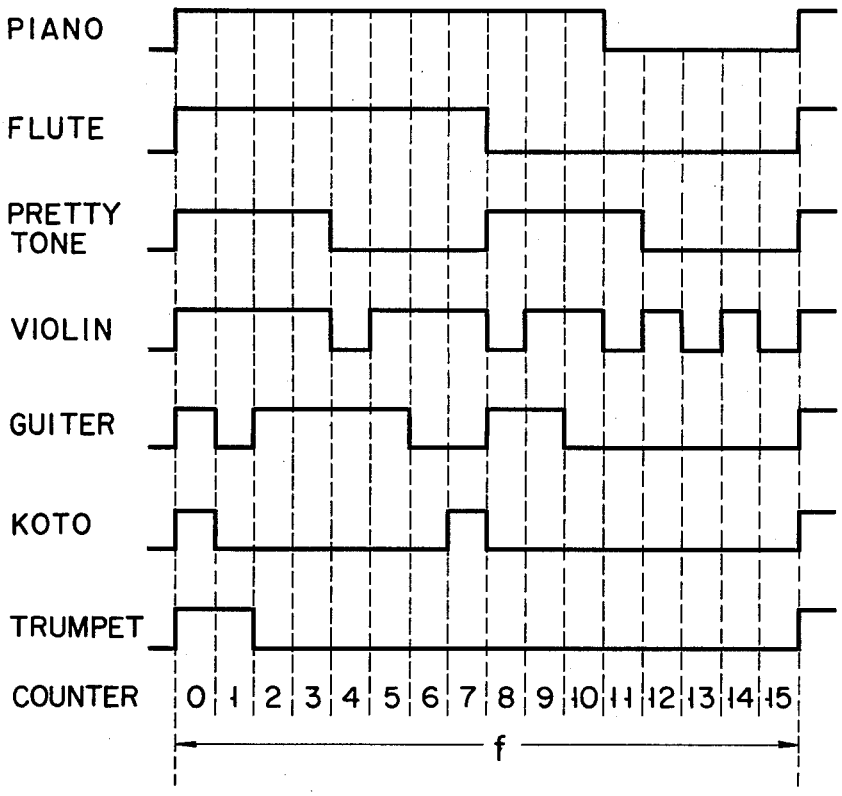
FIG. 8 is a view illustrating various waveforms of various timbre waveform data which is selected from the timbre waveform generator.

The counting value data from the 16-scale of counter 52 is supplied to a decoder 58 and decoded therein. When the counting value data is one of "0" to "15", the signal "1" is supplied from one of the corresponding output lines L0 to L15 to a timbre waveform generator 59. The decoded output from output lines 1 to 7 of the decoder 35 which decodes the timbre code is supplied to the timbre waveform generator 59. Timbre waveform data (that is, a clock waveform data signal "1" when the counting value of the 16-scale of counter 52 is between 0 to 10; and a clock waveform data signal "0" when the counting value of the 16-scale of counter 52 is between 1 to 15) when the timbre code as shown in FIG. 8 is 1 (which designates the timbre of piano), is output from an output line l1 of the timbre waveform generator 59. Therefore, the desired timbre of piano is given to the produced tone. Timbre waveform data which comprises different clock waveform data coresponding to the timbre codes 2 (flute) to 7 (trumpet) are output from the output lines l2 to l7. Therefore, a desired timbre such as flute, . . . , trumpet is given to the tone to be produced. The respective timbre waveform data which is, respectively, supplied from the output lines l1 to l7 is input to first input ends of NAND gates 61 to 64 through the OR gate 60. On the other hand, the envelope data which is output from the buffer register 30 is supplied to the second input ends of the NAND gates 61 to 64. The respctive outputs from the NAND gates 61 to 64 are supplied to the gates of corresponding CMOS transistors TR1 to TR4 in a D/A converter 65. In the CMOS transistors TR1 to TR4, a ground voltage GND is applied to the sources of the p-channel transistors and a negative power source voltage −VDD is applied to the drains of the n-channel transistors. Further, the drains of the p-channel transistors and the sources of the n-channel transistors are connected to each other and the resistors R22, R23 and R24 are connected to common nodes of the sources of the n-channel transistors and the drains of the p-channel transistors. On the other hand, one end of a resistor R1 is connected to a resistor R21, and the nnegative power source voltage −VDD is applied to the other end of the resistor R1. A resistor R31 is connected between the ends of the resistors R1 and R21 and the end of the resistor R22. A resistor R32 is connected between the ends of the resistors R22 and R23. A resistor R33 is connected between the ends of the resistors R23 and R24. The output voltage from the resistor R33 is supplied to the amplifier 21 and the speaker 22. The resistance of the resistors R21 to R24 is the same, and the resistance of the resistors R31 to R34 is the same. As a result, an analog tone signal whose envelope is controlled by the envelope data and which is provided with desired timbre by the timbre waveform data is output from the D/A converter 65 and produced at the sound producing section 4. An output L0 from the decoder 58 is supplied to the reset input end R of the flip-flop 46. When the 16-scale of counter 52 is reset, the flip-flop 46 is simultaneously reset.

Figure 6:
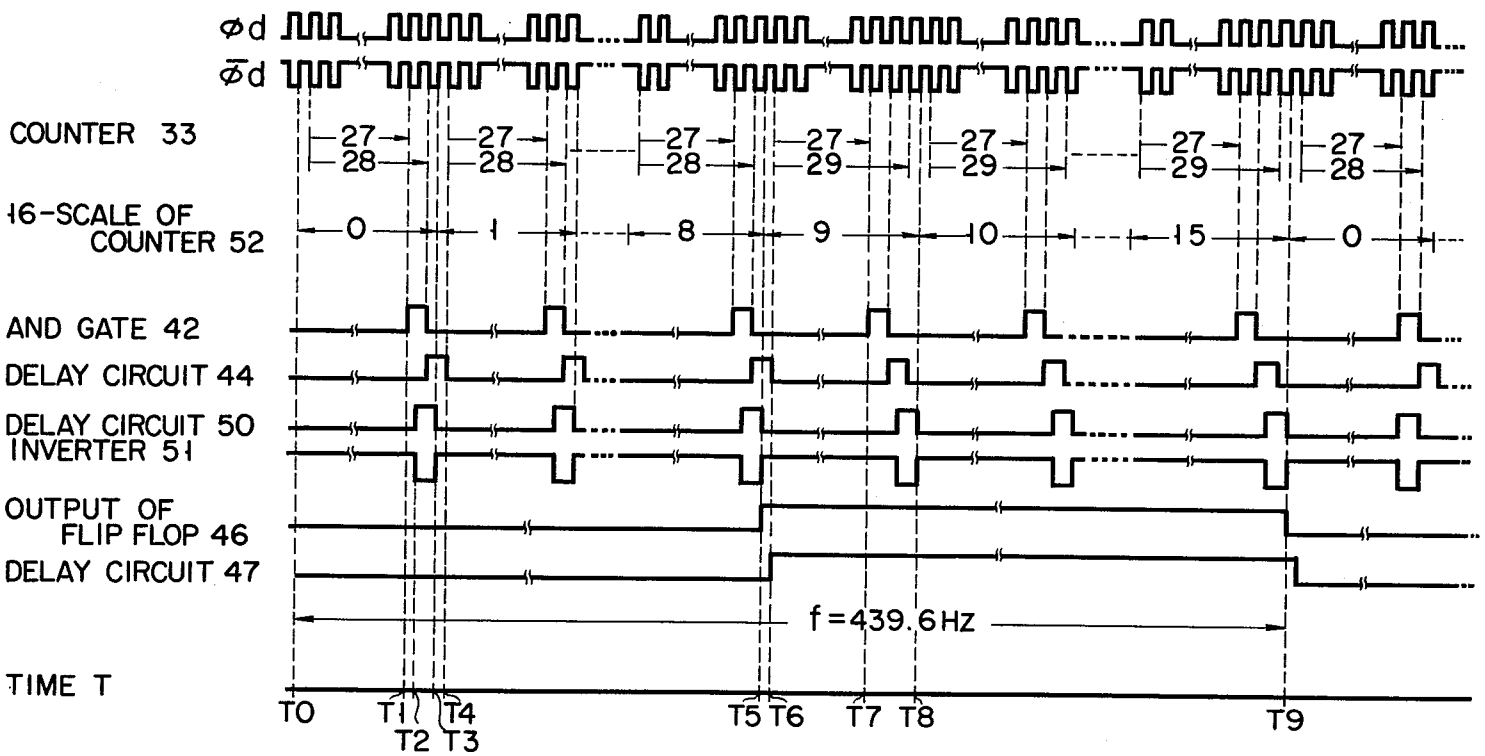
FIG. 6 is a time chart for explaining the mode of operation for a note generator.

The mode of operation of the electronic portable calculator in the play mode according to the above embodiment of the present invention will be described with reference to FIGS. 6 to 8. The mode changeover switch 9 is set to the position CAL. In this condition, data such as the attack portion of the envelope is keyed in with the ten keys. The mode changeover switch 9 is then set to the position PL. Assume that the timbre designation switch 8 is set to the position, for example, A so that the timbre of piano is selected. The timbre code "1" ("0001" in binary notation) and the clock signal $\phi$TC are supplied from the control section 13 to the buffer register 26 in the tone generator 18. The timbre code "1" is read in the buffer register 26 and supplied to the decoder 35. The decoder 35 decodes the timbre code "1" and supplies the signal "1" from the output line 1 which gives the timbre of piano. Thus, the output line l1 of the timbre waveform generator 59 is driven.

Assume that the [6] key which selects the pitch of the note A4 is depressed. The key operation signal and the key-in signal are output from the key input section 2 and supplied to the control section 13 and the envelope control section 14. In response to these signals, the control section 13 first supplies the code "13" to the X register (FIG. 4). Therefore, the note display "6" corresponding to the code "13" is displayed at the display section 3. The code "13" which is stored in the X register is transferred to the code converting section 17. As a result, the code converting section 17 converts the code "13" to the note codes F2=1, F1=11, and F0=9 (FIG. 4) which correspond to the frequency of 439.6 Hz and the counting value of 455. The converted codes are stored in the first to third areas F0 to F2 of the F register. The codes in the areas F2 to F0 are, respectively, transferred to the buffer registers 28, 27 and 29 in the tone generator 18. In response to the clock signals $\phi$F2, $\phi$F1 and $\phi$F0, the codes are, respectively, read in the buffer registers 28, 27 and 29. In this condition, when the octave shift switch 7 is set to the position H, the octave code "0" is supplied from the control section 13 to the tone generator 18. This octave code "0" is further supplied to the buffer register 25 in response to the clock signal $\phi$TC. On the other hand, the envelope control section 14, the vibrato control section 19 and the tremolo control section 20 initiate their operations in accordance with the data such as the envelope which is stored in the M register with the ten keys.

In the tone generator 18, the octave code "0" which is read in the buffer register 25 is decoded by the decoder 31. As a result, the clock signal $\phi$a having a frequency of 200 kHz is output from the decoder 31. The clock signal $\phi$a is supplied to the counter 33 through the OR gate 32 and counted therein (time T0 of FIG. 6). Further, the clock signals $\phi$d and $\phi$d having the same frequency as the clock signal $\phi$a are respectively output from the OR gate 32 and the inverter 34. The F1 code "11" ("1011" in binary notation) and the F2 code "1" ("01" in binary notation) are synthesized as 6-bit data which is, in turn, supplied to the corresponding exclusive NOR gates 36 to 41. On the other hand, the each-bit data which represents the counting value data of the counter 33 is supplied to the exclusive NOR gates 36 to 41. It is judged whether or not the content of the counting value data as described above coincides with the content of the 6-bit data, that is, "27" from the buffer registers 27 and 28. Every time the content of the counting value data becomes 27, the signal "1" is output from the AND gate 42. Further, each-bit data of the F0 code "9" ("1001" in binary notation) which is read in the buffer register 29 is supplied to the exclusive NOR gates 53 to 56. It is constantly detected whether or not the each-bit data coincides with the content of the counting value data of the 16-scale of counter 52. The envelope data from the sound pressure counter in the envelope control section 14 is sequentially read in the buffer register 30 in accordance with the control operation of the envelope control section 14, and the envelope data is then supplied to the NAND gates 61 to 64.

In each status as described above, the counting value data of the 16-scale of counter 52 is "0" before the counting value data of the counter 33 reaches the content of the 6-bit data which is synthesized by the F1 code and the F2 code, that is, "27", and after the [6] key corresponding to the pitch of the note A4 is depressed. Therefore, the signal "1" is output from the output line L0 of the decoder 58 only. In response to this signal, the SR flip-flop 46 is reset, so that the signal "1" is output from the output line l1 of the timbre waveform generator 59 as shown in FIG. 8. The signal "1" from the output line l1 is supplied to the NAND gates 61 to 64 through the OR gate 60. In this condition, since the flip-flop 46 is reset, the AND gate 45 is rendered conductive and the AND gate 45 is rendered nonconductive. The analog tone signal is produced from the D/A converter 65 in response to the outputs from the NAND gates 61 to 64. The sound with the pitch of the note A4 which has the timbre of piano is produced from the speaker 22.

When the counting value data of the counter 33 reaches 27, a first pulse, that is, the signal "1" is output from the AND gate 42 and supplied to the AND gate 43 and the one-bit delay circuit 44 (time T1). A pulse signal in synchronism with the signal "1" as described above is output from the AND gate 43 and supplied to the delay circuit 50 through the OR gate 49. At time T2, that is, when time for one bit elapses in response to the clock signal $\overline{\phi d}$, the output from the delay circuit 50 is inverted to the signal "1". In response to this signal "1", the output from the inverter 51 is inverted to the signal "0". In the period of time T1 to time T2, the counting value data of the counter 33 is incremented by 1 so that the counting value becomes 28. In synchronism with the leading edge of the signal from the inverter 51 which is inverted to the signal "1" at time T3, the counter 33 is reset and the content of the 16-scale of counter 52 is incremented by 1 so that the counting value data becomes "1". Therefore, the counter 33 initiates the counting operation at time T4 in which the clock signal $\phi b$ is output. Further, the signal "1" is output from only the output line L1 of the decoder 58 in response to the counting value data 1 of the 16-scale of counter 52. The set input end S and the reset input end R of the flip-flop 46 are both set to "0". However, the reset status of the flip-flop 46 does not change, so that the AND gate 43 is rendered conductive and the AND gate 45 is rendered nonconductive. These conditions are the same period as the period of time T0 to T4. The signal "1" is output from the output line L1 of the decoder 58, so that the output line l1 of the timbre waveform generator 59 continues to output the signal "1". Therefore, the tone with the timbre of piano is continuously produced at the speaker 22.

The operations during the period of time T0 to T4 are repeated until the content of the counting value data of the 16-scale of counter 52 reaches the content "9" of the F1 code, that is, until time T5 has elapsed. In the period of time T4 to time T5, the flip-flop 46 is kept in the reset condition, and the counter 33 is reset and initiates counting from 0 to 28 and the 16-scale of counter 52 is incremented by 1 so that the counting value data thereof increases from 1 to 8, every time the counting value data of the counter coincides with the value 28 which is obtained by adding 1 to the content of the value "27" which is defined by the F1 code and the F2 code. In this period, the signal "1" is sequentially output from the output lines L2 to L8 of the decoder 58 and supplied to the timbre waveform generator 59. In response to this signal, the signal "1" is continuously output from the output line l1 of the timbre waveform generator 59. This signal "1" is supplied to the NAND gate 61 to 64 through the OR gate 60. In the period of time T4 to time T5, the D/A converter 65 is driven by the outputs from the NAND gate 61 to 64, so that the tone corresponding to the pitch of the note A4 with the timbre of piano is produced at the speaker 22.

At time T5, the counter 33 is reset in response to the output from the inverter 51. Simultaneously, the counting value data of the 16-scale of counter 52 is incremented by 1 so that the counting value data becomes 9. The counter 33 initiates the counter operation. On the other hand, at the same time, the coincidence between the counting value data "9" of the 16-scale of counter 52 and the F0 code "9" is detected, so that the signal "1" is output from the AND gate 57. This signal "1" is supplied to the set input end S of the flip-flop 46. Therefore, the flip-flop 46 is in the set status. For this reason, the set output from the flip-flop 46 becomes level "1" and the output of the one-bit delay circuit 47 becomes level "1" by the clock signal $\phi d$, one-bit time after the flip-flop 46 outputs the signal "1" from its output end. The signal "1" from the one-bit delay circuit 47 is supplied to the AND gate 45 and the inverter 48. Therefore, at this time (time T6), the AND gate 43 is rendered nonconductive and the AND gate 45 is rendered conductive. The counting value data "9" from the 16-scale of counter 52 is decoded by the decoder 58, and the signal "1" is output from only the output line L9 of the decoder 58. In response to the signal "1" from the decoder 58, the signal "1" is output from the output line l1 of the timbre waveform generator 59. Therefore, the tone corresponding to the tone of the note A4 with the timbre of piano is continuously produced at the speaker 22.

At time T7, the counting value data of the counter 33 becomes 27 and the pulse signal, that is, the signal "1" is output from the AND gate 42. This signal "1" is delayed by two bits with the two delay circuits 44 and 50 and supplied to the inverter 51. For this reason, the counting value data of the counter 33 is incremented by 2, that is, the counting value data becomes 29. At time T8, the counter 33 is reset and simultaneously the counting value data of the 16-scale of counter 52 is incremented by 1, that is, the counting value data of the 16-scale of counter 52 becomes 10. For this reason, the output of the AND gate 57 is of level "0" from time T8 and inputs to both input ends S and R of the flip-flop 46 are at level "0" so that its set status is maintained. Therefore, the AND gate 43 is rendered nonconductive and the AND gate 45 is rendered conductive. This condition of the AND gates 43 and 45 is the same as in the period of time T6 to time T8. The signal "1" is output from only the output line L10 of the decoder 58 and supplied to the timbre waveform generator 59. The signal "1" is continuously output from the output line l1 of the timbre waveform generator, so that the tone corresponding to the pitch of the note A4 with the timbre of piano is produced at the speaker 22.

The operation in the period of time T5 to T8 is the same as the period until time T9 in which the 16-scale of counter 52 is reset and restores to the status in time T0, except for the operation of the timbre waveform generator 59. That is, in the period of time T8 to T9, the flip-flop 46 is kept in a set status so that the counting value of the counter 33 reaches the counting value 29 which is obtained by adding 2 to the value 27 defined by the F1 and F2 codes. When the counter 33 counts up 29, the counnter 33 is reset and repeats the counting operation beginning from 0 to 29. On the other hand, the counting value of the 16-scale of counter 52 is incremented by 1 so that the counting value thereof changes to 11, 12, . . . , 15. In correspondence with the changes in the counting value of the 16-scale of counter 52, the signal "1" is sequentially output from the output lines L11 to L15 of the decoder 58 and is supplied to the timbre waveform generator 59. Therefore, the signal "0" is output from the line l1 of the timbre waveform generator 59 for this period, as shown in FIG. 8. This signal "0" is supplied to the NAND gates 61 to 64 through the OR gate 60. For this reason, the outputs from the NAND gate 61 to 64 are of level "1". The D/A converter 65 is then driven by these signals. The operating condition of the D/A converter 65 for this period is different from that for the period of time T0 to T8, so that the tone to be produced is provided with the timbre of piano.

When the 16-scale of counter 52 is reset at time T9, as described above, the counter 33 initiates the counting operation in the same manner as in the period of time T0 to T6, beginning from 0 to 28. In accordance with this counting operation, the counting value of the 16-scale of counter 52 is incremented by 1. As described above, one period of the frequency f=439.6 Hz of the pitch signal of the pitch of the note A is completed by the operation in which the signal "0" and the signal "1" are output from each set output end of the flip-flop 46 for the periods of time T0 to time T5 and time T5 to time T8, respectively. The total counting value of the counter 33 for this period is 455, as shown in FIG. 4.

The basic operation of the tone generator 13 is repeated when the [6] key, corresponding to the pitch of the tone A4, is being depressed. Further, for this period, since the envelope data which sequentially changes under the control of the envelope control section 14 is supplied to the buffer register 30, the D/A converter 65 is driven by each envelope data and by the timbre waveform data from the timbre waveform generator 59 in accordance with the contents of the data. Therefore, the tone to be produced is provided with the timbre of piano and produced with the pitch of the note A4 at the speaker 22. When the 6 key is released, the release portion of the envelope affects the tone so that the tone gradually disappears.

When a timbre code is to be entered by the ten keys, the mode changeover switch 9 is set to the position CAL and the timbre designation switch 8 is set to the position F. If the timbre of guitar is to be selected, the [5] key among the ten keys is depressed. Therefore, the timbre code "5" is stored in the 8th bit M7 of the M register in the memory 15. As a result, after melody performance is initiated, the timbre code "5" in the M register is read in the buffer 26 of the tone generator 18 and supplied to the decoder 35. The code "5" is decoded by the decoder 35 and generated from the output line 5 of the decoder 35 as the signal "1" which gives the timber of guitar. Thus, the output line l5 of the timbre waveform generator 59 is driven. As shown in FIG. 8, when the counting value data of the 16-scale of counter 52 is 0, 2 to 5, 8 and 9, the signal "1" which is the clock signal corresponding to the timbre waveform data which has the timbre of guitar is output for each period so that the timbre provided with the timbre of guitar is produced at the speaker 22. On the other hand, when the counting value data of the 16-scale of counter 52 is 1, 6, 7, 10 to 15, the signal "0" is output for each period for the purpose as described above.

In the above embodiment, the present invention is applied to an electronic portable calculator with a tone generating function. Further, the present invention can also be applied to other electronic equipment with a tone generating function. Alternatively, ten keys are arranged in an electronic musical instrument such as an electronic organ or the like and data such as a timbre code is input for controlling the timbre. The number and kinds of timbre are not limited to those in the above embodiment. The number and kinds of timbre may be arbitrarily determined. The content of data of the timbre waveform which is generated from the timbre waveform generator 59 is also determined arbitrarily.

What is claimed is:

1. Electronic equipment having a tone generating function comprising:

timbre memory means for storing timbre waveforms as a digital value, said timbre memory means having n bit positions (where n is a positive integer);

said readout means reading out the specified timbre waveform from said timbre memory means by counting said reference signals, said readout means including means for counting said reference signals m times (where m is a positive integer) at a positions of n positions (where a is a positive integer and a $<$n), and for counting said reference signals (m+1) times at (n-a) positions, said specified timbre waveform of said timbre memory means being read out at a note frequency $F=f/[n(m+1)-a]$.

2. Electronic equipment having a tone generating function according to claim 1, in which said addressing means includes means for sequentially accessing a bit positions by counting said reference signals m times, and for then accessing (n-a) bit positions by counting said reference signals (m+1) times.

3. Electronic equipment having a tone generating function comprising:

timbre memory means for storing timbre waveforms as a digital value, said timbre memory means having n bit positions (where n is a positive integer), each bit position storing a binary coded signal of a level "1" or "0" in accordance with the type of timbres;

a source of reference signals having a frequency f; and addressing means coupled to said timbre memory means for sequentially accessing said timbre memory means by counting said reference signals having said frequency f for each bit, said addressing means including means for counting said reference signals m times (where m is a positive integer) at a bit positions of n bit positions (where a is a positive integer; and where a$<$n), and for counting said reference signal (m+1) times at (n-a) bit positions in which said timbre waveform of said timbre memory means is read out at a note frequency $F=f/[n(m+1)-a]$.

4. Electronic equipment having a tone generating function according to claim 3, in which said addressing means includes means for sequentially accessing a bit positions by counting said reference signals m times, and for then accessing (n-a) bit positions by counting said reference signals (m+1) times.

5. Electronic equipment having a tone generating function comprising:

timbre memory means for storing a plurality of timbre waveforms as a digital value, each of said timbre waveforms corresponding to a peculiar number;

said timbre memory means having n bit positions, each bit position storing a binary coded signal of a level "1" or "0" in accordance with the type of timbres for each position;

numeric keys being operable for inputting numeric data which is operated on by the electronic equipment to produce a numeric result;

converting means coupled to said numeric keys for enabling said numeric keys to input a peculiar number so as to specify a timbre waveform out of said plurality of timbre waveforms stored in said timbre memory means;

means coupled to said timbre memory means and responsive to said peculiar number input by said numeric keys for reading out a specified timbre waveform from said timbre memory means; and musical tone generating means coupled to said timbre memory means for generating a musical tone according to said specified timbre waveform read out from said timbre memory means.

6. Electronic equipment having a tone generating function comprising:

timbre memory means for storing a plurality of timbre waveforms as a digital value, each of said timbre waveforms corresponding to a peculiar number;

operating means for performing arithmetic operations including at least addition, subtraction, multiplication and division;

numeric keys which are operable for inputting numeric data which is operated on by said operating means of the electronic equipment to produce a numeric result;

function keys for specifying arithmetic operations to be performed by said operating means; and means coupled to said numeric keys for enabling said numeric keys to input numeric data to said operating means;

said arithmetic operations with said numeric data input by said numeric keys being selectively performed in response to operation of said function keys;

converting means coupled to said numeric keys for enabling said numeric keys to input a peculiar number so as to specify a timbre waveform out of said plurality of timbre waveforms stored in said timbre memory means;

readout means coupled to said timbre memory means and responsive to said peculiar number input by said numeric keys for reading out a specified timbre waveform from said timbre memory means; and musical tone generating means coupled to said timbre memory means for generating a musical tone according to said specified timbre waveform read out from said timbre memory means.

7. Electronic equipment according to claim 6, further including means coupled to said numeric keys and to said musical tone generating means for enabling said numeric keys to designate respective musical notes so as to generate a musical sound.

8. Electronic equipment according to claim 6, wherein said timbre memory means includes n memory positions, where n is a positive integer, each of said n memory positions storing a binary coded signal of a level "1" or "0" in accordance with the type of timbres for each position.

9. Electronic equipment having a tone generating function comprising:

a source of reference signals having a frequency f;

timbre memory means for storing a plurality of timbre waveforms as a digital value, each of said timbre waveforms corresponding to a peculiar number, said timbre memory means including n memory positions, where n is a positive integer, each of said n memory positions storing a binary coded signal in accordance with the type of timbre;

numeric keys being operable for inputting numeric data which is operated on by the electronic equipment to produce a numeric result;

converting means coupled to said numeric keys for enabling said numeric keys to input a peculiar number so as to specify a timbre waveform out of said polarity of timbre waveforms stored in said timbre memory means;

readout means coupled to said timbre memory means and responsive to said peculiar number input by said numeric keys for reading out a specified timbre waveform from said timbre memory means; and musical tone generating means coupled to said timbre memory means for generating a musical tone according to said specified timbre waveform read out from said timbre memory means;

a source of reference signals having a frequency f; and addressing means coupled to said timbre memory means for sequentially accessing said timbre memory means by counting said reference signals having said frequency f for each bit, said addressing means including means for counting said reference signals m times (where m is a positive integer) at a bit positions of n bit positions (where a is a positive integer; and where $a<n$), and for counting said reference signal (m+1) times at (n-a) bit positions in which said timbre waveform of said timbre memory means is read out at a note frequency $F=f/[n(m+1)-a]$.

10. Electronic equipment according to claim 9, further including means coupled to said numeric keys and to said musical tone generating means for enabling said numeric keys to designate respective musical notes so as to generate a musical sound.

11. Electronic equipment according to claim 9, wherein said timbre memory means stores a binary coded signal of a level "1" or "0" in accordance with the type of timbres for each position.

* * * * *

UNITED STATES PATENT AND TRADEMARK OFFICE

CERTIFICATE OF CORRECTION

PATENT NO. : 4,475,429

DATED : October 9, 1984

INVENTOR(S) : Kazuyasu Suzuki

It is certified that error appears in the above-identified patent and that said Letters Patent is hereby corrected as shown below:

Column 14, line 34, change "polarity" to --plurality--.

Amend claims 1 and 19 to read as follows:

1. Electronic equipment having a tone generating function comprising:

timbre memory means for storing timbre waveforms as a digital value, said timbre memory means having n bit positions (where n is a positive integer);

a source of reference signals having a frequency f; and addressing means coupled to said timbre memory means for sequentially accessing said timbre memory means by counting said reference signals having said frequency f for each bit, said addressing means including means for counting said reference signals m times (where m is a positive integer) at a bit positions of n bit positions (where a is a positive

UNITED STATES PATENT AND TRADEMARK OFFICE

CERTIFICATE OF CORRECTION

PATENT NO. : 4,475,429

DATED : October 9, 1984

INVENTOR(S) : Kazuyasu SUZUKI

It is certified that error appears in the above-identified patent and that said Letters Patent is hereby corrected as shown below:

integer; and where a <n), and for counting said reference signal (m+1) times at (n-a) bit positions in which said timbre waveform of said timbre memory means is read out at a note frequency F = f/[n(m+1)-a].

UNITED STATES PATENT AND TRADEMARK OFFICE

CERTIFICATE OF CORRECTION

PATENT NO. : 4,475,429

DATED : October 9, 1984

INVENTOR(S) : Kazuyasu Suzuki

It is certified that error appears in the above-identified patent and that said Letters Patent is hereby corrected as shown below:

9. Electronic equipment having a tone generating function comprising:

a source of reference signals having a frequency f;

timbre memory means for storing a plurality of timbre waveforms as a digital value, each of said timbre waveforms corresponding to a peculiar number, said timbre memory means including n memory positions, where n is a positive integer, each of said n memory positions storing a binary coded signal in accordance with the type of timbre;

numeric keys being operable for inputting numeric data which is operated on by the electronic equipment to produce a numeric result;

converting means coupled to said numeric keys for enabling said numeric keys to input a peculiar number so as to specify a timbre waveform out of said plurality of timbre PATENT NO. : 4,475,429
DATED : October 9, 1984
INVENTOR(S) : Kazuyasu Suzuki It is certified that error appears in the above-identified patent and that said Letters Patent is hereby corrected as shown below:

waveforms stored in said timbre memory means;

readout means coupled to said timbre memory means and responsive to said peculiar number input by said numeric keys for reading out a specified timbre wave form from said timbre memory means; and musical tone generating means coupled to said timbre memory means for generating a musical tone according to said specified timbre waveform read out from said timbre memory means; and said readout means reading out the specified timbre waveform from said timbre memory means by counting said reference signals, said readout means including means for counting said reference signals m times (where m is a positive integer) at a positions of n positions (where a is a positive

UNITED STATES PATENT AND TRADEMARK OFFICE

CERTIFICATE OF CORRECTION

PATENT NO. : 4,475,429

DATED : October 9, 1984

INVENTOR(S) : Kazuyasu Suzuki

It is certified that error appears in the above-identified patent and that said Letters Patent is hereby corrected as shown below:

integer and a $<$n), and for counting said reference signals (m+1) times (n-a), positions, said specified timbre waveform of said timbre memory means being read out at a note frequency F = f[n(m+1)-a].

Signed and Sealed this

*Ninth* Day of *July 1985*

[SEAL]

*Attest:*

DONALD J. QUIGG

*Attesting Officer* *Acting Commissioner of Patents and Trademarks*